US007828701B1

(12) United States Patent
Chen

(10) Patent No.: US 7,828,701 B1
(45) Date of Patent: Nov. 9, 2010

(54) KUNG FU TRAINING DEVICE

(76) Inventor: Yi-Lin Chen, 3F.-5, No. 262, Sec. 2, Henan Rd., Situn District, Taichung City 407 (TW)

( * ) Notice: Subject to any disclaimer, the term of this patent is extended or adjusted under 35 U.S.C. 154(b) by 57 days.

(21) Appl. No.: 12/540,294

(22) Filed: Aug. 12, 2009

(51) Int. Cl.
*A63B 21/00* (2006.01)

(52) U.S. Cl. ..... 482/83; 482/87; 482/90

(58) Field of Classification Search ..... 482/83–90; 446/298; 473/446, 441–445; 472/128
See application file for complete search history.

(56) References Cited

U.S. PATENT DOCUMENTS

2009/0098985 A1* 4/2009 Gonzalez ..... 482/83
2009/0247374 A1* 10/2009 Chen ..... 482/89
2009/0264262 A1* 10/2009 Brenner et al. ..... 482/83

* cited by examiner

*Primary Examiner*—Jerome Donnelly
(74) *Attorney, Agent, or Firm*—Banger Shia

(57) ABSTRACT

A kung fu training device of the present invention includes a positioning portion, a body pole, a shoulder portion, two joint portions, two arm portions and several pins. Polygonal holes and corresponding polygonal poles are disposed on pivoting ends of the shoulder, the first and second joints of the joint portions, and the arm connectors of the arm portions respectively. Thereby, the fist pads disposed on the distal ends of the arm portions are height-adjustable and angle-adjustable about the body pole, and the heights of the shoulder portion and the head portion are also adjustable. As a result, the training device of the present invention is suitable for the trainees with different body sizes to simulate fighting with simulating enemies with different body sizes, so as meet the trainees' need.

13 Claims, 10 Drawing Sheets

KUNG FU TRAINING DEVICE

BACKGROUND OF THE INVENTION

1. Field of the Invention

The present invention relates to a kung fu training device, more particularly to a training device that can adjust the heights of and the relative distances between three hitting pads.

2. Description of the Prior Art

One of the most typical kung fu training device having three hitting portion is called wooden dummy. A wooden dummy has three hitting pole with fixed angle and relative position for the trainee to practice attack and defense tricks, and eventually it becomes a popular kung fu training device.

For realistic training or other purposes, the wooden dummy is constantly promoted, such as disclosed in U.S. Pat. No. 3,250,533, U.S. Pat. No. 4,387,892, U.S. Pat. No. 4,593,900, U.S. Pat. No. 4,765,609, U.S. Pat. No. 4,770,412, U.S. Pat. No. 5,256,069, U.S. Pat. No. 5,700,230, U.S. Pat. No. 5,899,835, U.S. Pat. No. 6,152,863 and U.S. Pat. No. 6,808,477.

However, not every trainee has the same height and body size, nor do all the simulating enemies have the same height, body size, attack and defense tricks. Thus, a kung fu training device is required to have adjustable hitting portions that can meet the trainee's need.

Some conventional kung fu training devices are therefore provided to achieve the above mentioned requirement. For example, TWM328888 provides a training device, which utilizes two discs having annularly-disposed teeth to engage with each other, thereby adjusting the included angle between the hitting portion and the pole. However, such annularly-disposed teeth are easily disengaged from each other due to the overloaded instantaneous force output by the trainee. Also, the teeth will be worn out eventually and lost its positioning function. That is, the durability of such training device is a problem. Moreover, the length of the hitting portion is still limited so that such training device cannot simulate enemies with different body sizes.

SUMMARY OF THE INVENTION

The main object of the present invention is to provide a kung fu training device with height-adjustable and relative-distance-adjustable hitting portions.

To achieve the above object, a kung fu training device of the present invention includes a positioning portion, a body pole, a shoulder portion, two joint portions, two arm portions and several pins. Polygonal holes and corresponding polygonal poles are disposed on pivoting ends of the shoulder, the first and second joints of the joint portions, and the arm connectors of the arm portions respectively. Thereby, the fist pads disposed on the distal ends of the arm portions are height-adjustable and angle-adjustable about the body pole, and the heights of the shoulder portion and the head portion are also adjustable. As a result, the training device of the present invention is suitable for the trainees with different body sizes to simulate fighting with simulating enemies with different body sizes, so as meet the trainees' need.

The present invention will become more obvious from the following description when taken in connection with the accompanying drawings, which show, for purpose of illustrations only, the preferred embodiments in accordance with the present invention.

DETAILED DESCRIPTION OF THE PREFERRED EMBODIMENTS

Figure 1:
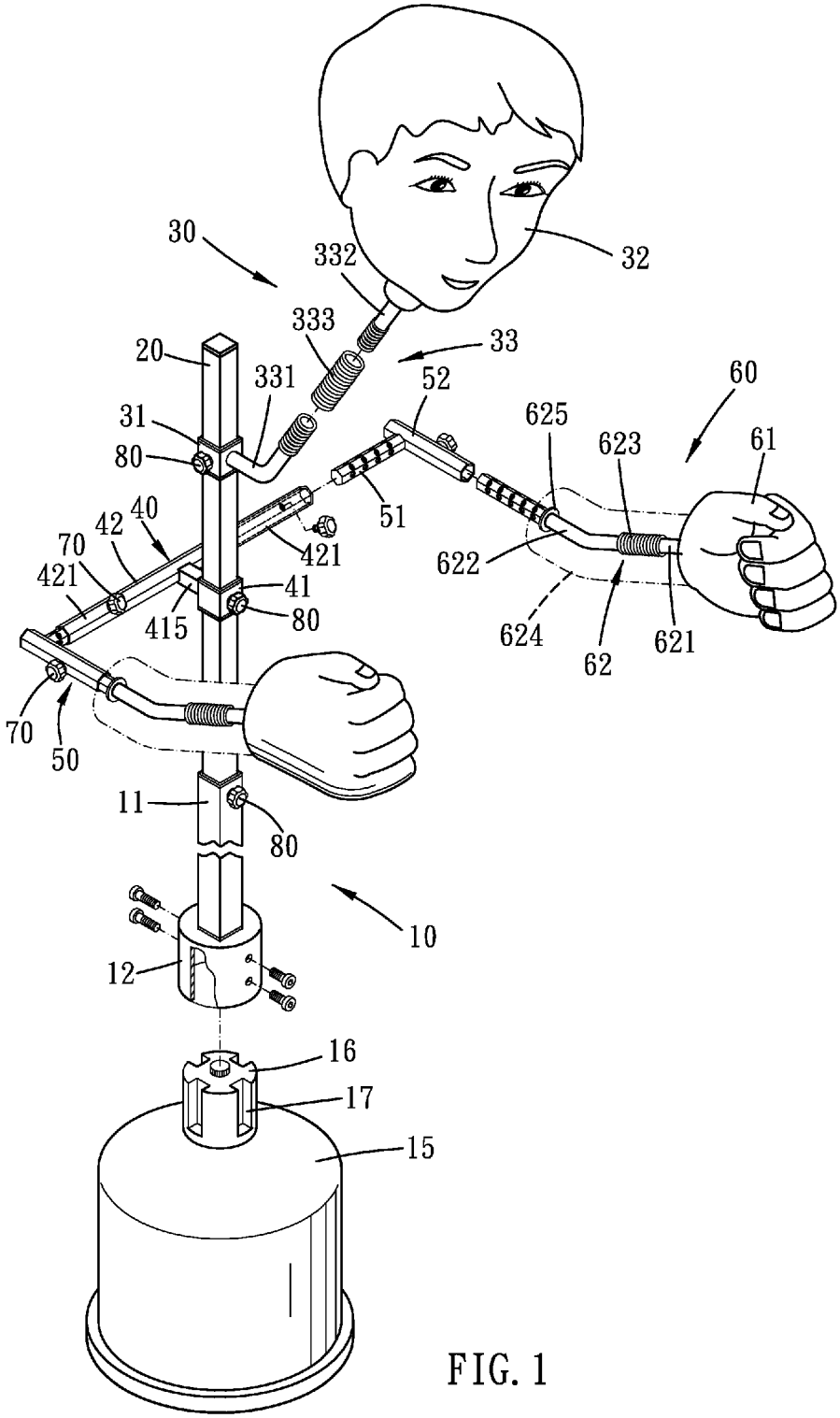
FIG. 1 is a partial explosive drawing showing a kung fu training device in accordance with a first preferred embodiment of the present invention.
Figure 2:
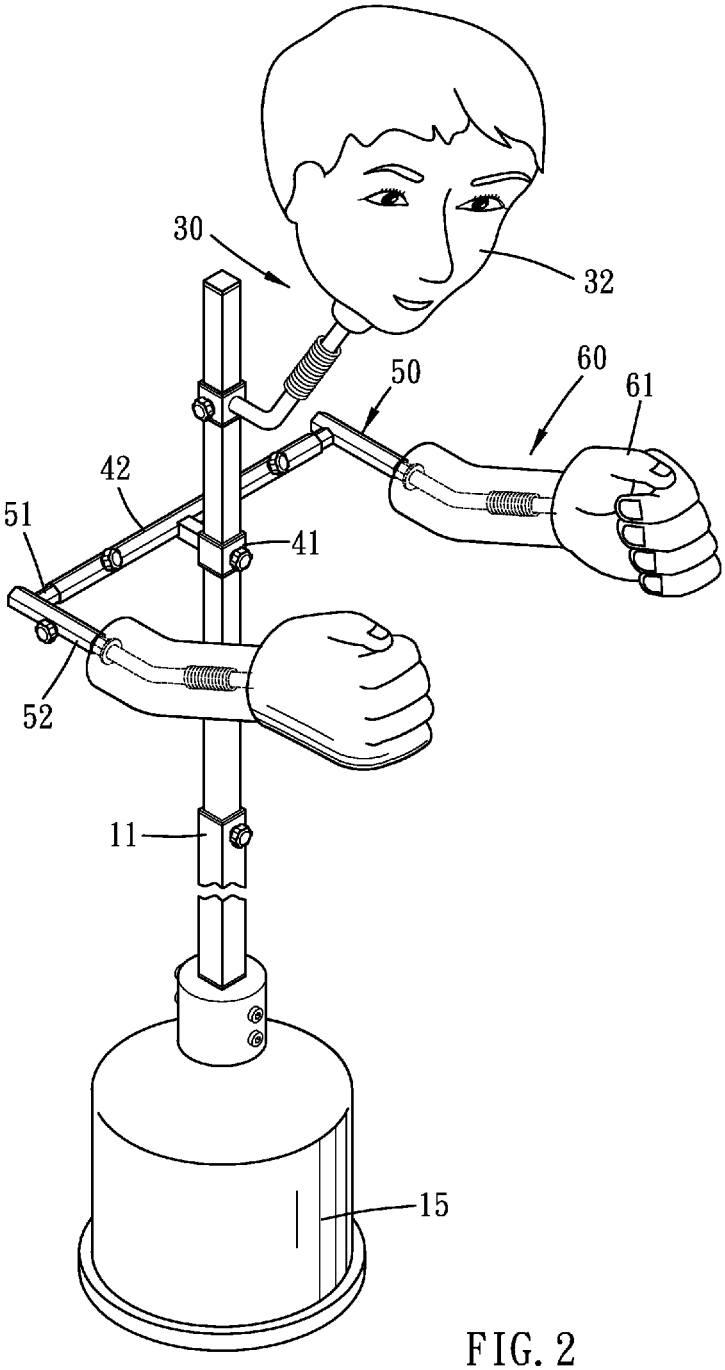
FIG. 2 is a combination drawing showing a kung fu training device in accordance with a preferred embodiment of the present invention.
Figure 3:
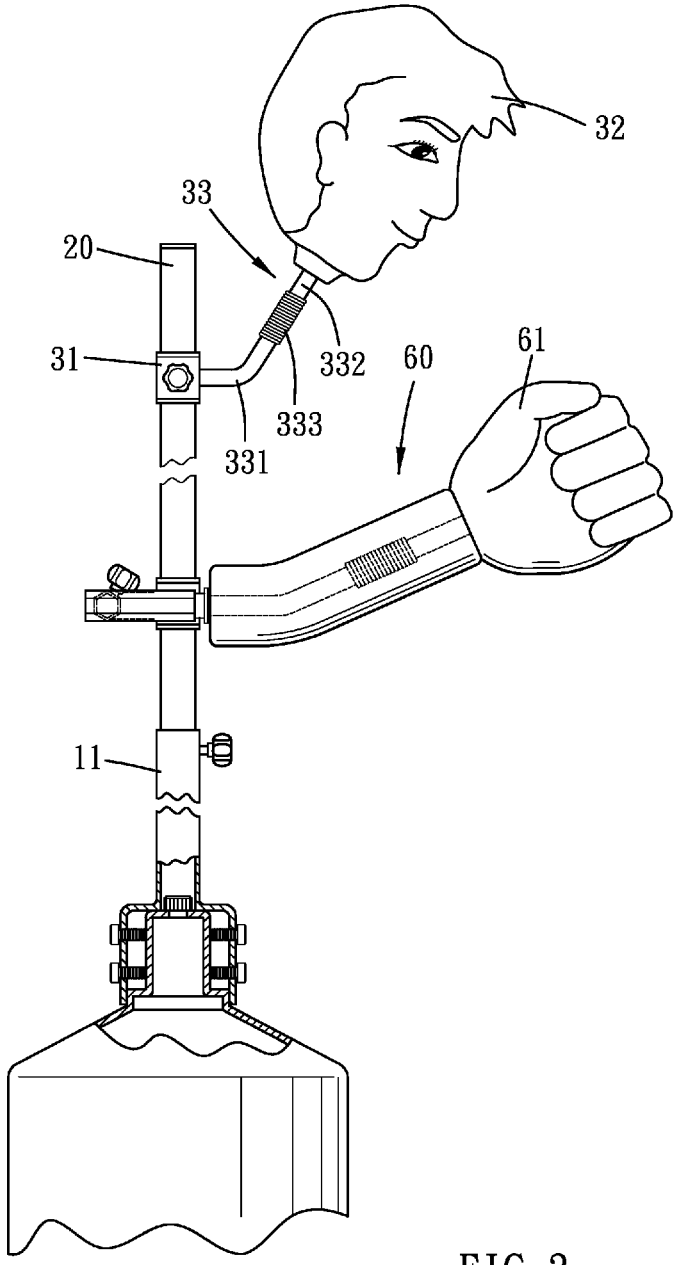
FIG. 3 is a first partial side perspective drawing showing a kung fu training device in accordance with a first preferred embodiment of the present invention.
Figure 4:
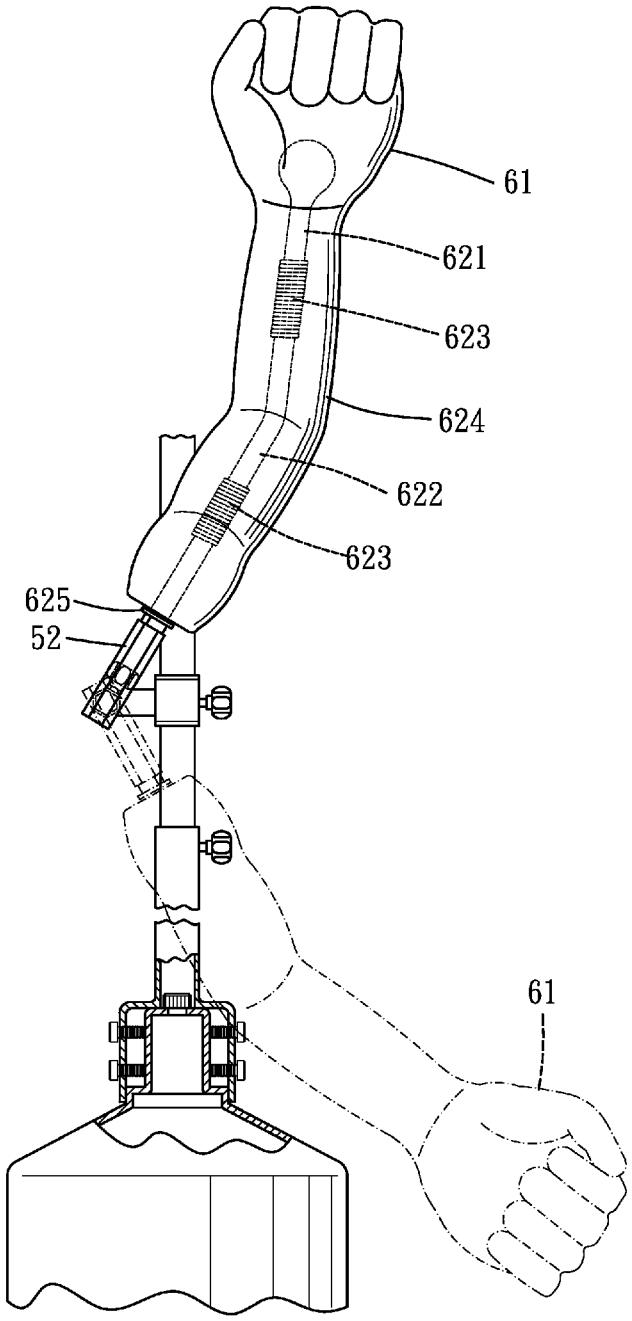
FIG. 4 is a side view showing a kung fu training device in accordance with a second preferred embodiment of the present invention.

Please refer to FIG. 1 to FIG. 3 for a first embodiment of the present invention. A kung fu training device includes a positioning portion 10, a base 15, a body pole 20, a head portion 30, a shoulder portion 40, two joint portions 50, two arm portions 60 and several pins 70.

The positioning portion 10 is a tube with a rectangular, any polygonal or other geometric profile. The positioning portion 10 has a socket 11 with an opening facing upward. A bottom end of the positioning portion has an enlarged sleeve 12, which has a larger diameter than that of a circumcircle of the socket's 11 profile. The sleeve 12 mates with a protrusion 16 disposed on the base 15. Several screws are used to further fix the sleeve 12 to the protrusion 16. In addition, at least one groove 17 may be axially formed on the protrusion, and at least one rib (not shown) may be formed on the inner walls of the sleeve 12 to engage with the groove 17 in an unrotatable manner. The base 15 is heavy weighted so that the center of gravity of the whole set of the training device lies within the periphery of the base 15. Preferably, the base 15 has an inner space to stuff liquid, such as water, or solid particles, such as sand, therein.

The body pole 20 also has a rectangular profile, and it may be hollow or solid. A bottom end of the body pole 20 is inserted into the socket 11, and the body pole 20 extends upright therefrom.

The head portion 30 includes a head tube 31, a head pad 32 and a head connector 33 connecting the head tube 31 with the head pad 32. The head tube 31 has a rectangular hole to releasably surround a part of the body pole 20. The head connector 33 includes a first section 331, a second section 332 and a head coil spring 333. One end of the first section 331 connects to the head tube 31, and one end of the second section 332 connects to the head pad 32. Distal ends of the first section 331 and the second section 332 are formed with threads that mate with two ends of the head coil spring 333 respectively. Preferably, the first section 331 is bent upward to include an angle of 135 degrees, such that the head pad 32 protrudes out from the body pole 20. The head pad 32 may be an air bag, a foaming object or the same that provides suitable feedback.

The shoulder 40 has a shoulder tube 41 and a lateral rod 42 which substantially perpendicular to the body pole 20. The lateral rod 42 may directly in contact with the shoulder tube 41, or it may indirectly connect to the shoulder tube 41 by a connecting section 415. In the present embodiment, the shoulder tube 41 indirectly connects to (but not limited to) a middle point of the lateral rod 42. Both ends of the lateral rod 42 are formed with a pivoting end respectively. The shoulder tube 41 also has a rectangular tube 41 that can releasably surround a part of the body pole and be disposed beneath the head tube 31. An adjusting means is provided to adjust relative positions between the socket 11, the head tube 31, the shoulder tube 41 and the body pole 20. The adjusting means includes several holes disposed along a longitudinal direction of the body pole 20, and includes through holes respectively disposed on the head tube 31, the shoulder tube 41, and the socket 11. The adjusting means further includes several pins 80 that insert in the through holes and their corresponding holes respectively for positioning purpose. When the height of either the head tube 31 or the shoulder tube 41 is to be adjusted, the pin 80 is withdrawn from the hole of the body pole 20 so that the head tube 31 or the shoulder tube 41 is slidable along the longitudinal direction of the body pole 20 until the pin 80 once again inserts into a hole of the body pole 20. The adjusting means may include clamps instead, i.e. the head tube and the shoulder tube may be clamps that can releasably clamp the body pole.

Each of the joint portions 50 has a first joint 51 and a second joint 52 that connects to the first joint 51. An included angle is defined between the joints 51, 52, and it is preferred a substantially perpendicular angle.

Each of the arm portions 60 has a fist pad 61 and an arm connector 62. The arm connector 62 is disposed between the fist pad 61 and the second joint 52 of the joint portion 50. One of each pivoting end 451 and its corresponding first joint 51 has a right polygonal hole, and the other of them has a corresponding right polygonal pole. Likewise, one of each second joint 52 and its corresponding arm connector 62 has a polygonal hole, and the other of them has a corresponding right polygonal pole. For example, each pivoting end 421 of the present invention is a right polygonal hole, and each first joint 51 is a corresponding right polygonal pole; also, each second joint 52 is a right polygonal hole, and one end of each arm connector 62 is a corresponding right polygonal pole. Each right polygonal hole is defined by several side walls. At least one of the side walls has at least one bore which penetrates such side wall, and the at least one bore is disposed along a longitudinal direction of the side wall. Each right polygonal pole has several pole surfaces. At least one of the pole surfaces has at least one fixation hole disposed along a longitudinal direction of such pole surface. Among each polygonal pole and its corresponding polygonal hole, at least one of the amount of the side wall(s), which has/have at least one bore, and the amount of the pole surface(s), which has/have at least one fixation hole, is a complex number. For example, each polygonal hole of the present embodiment has only one side wall that has a bore disposed thereon, yet every pole surface of its corresponding polygonal pole is formed with fixation holes, i.e. the amount of pole surfaces that have fixation holes is a complex number. Furthermore, among each side wall and its corresponding pole surface, at least one of the amount of the bore(s), which is/are disposed on such side wall, and the amount of the fixation hole(s), which is/are disposed on the pole surface, is a complex number. For example, each side wall of the present embodiment has one bore at most, yet each pole surface has several fixation holes. As such, the polygonal pole may rotate about its axis and thereafter insert into its corresponding polygonal hole. Also, the depth of the insertion of the polygonal pole into the polygonal hole is also adjustable. The pins 70 are therefore used to insert in the bores and their corresponding fixation holes to fix the relative position between the polygonal hole and the polygonal pole. Moreover, a gasket may be disposed between each right polygonal hole and its corresponding right polygonal pole.

The arm connector 62 of the present embodiment is bent into a forearm 621 and an upperarm 622. The forearm 621 makes an included angle of about 15 degrees to the upperarm 622. In the present embodiment, the forearm 621 has two sub-sections and an arm coil spring 623 disposed between the two sub-sections. Specifically, two ends of the arm coil spring 623 mate with the sub-sections respectively, just like the head connector 33.

Figure 5:
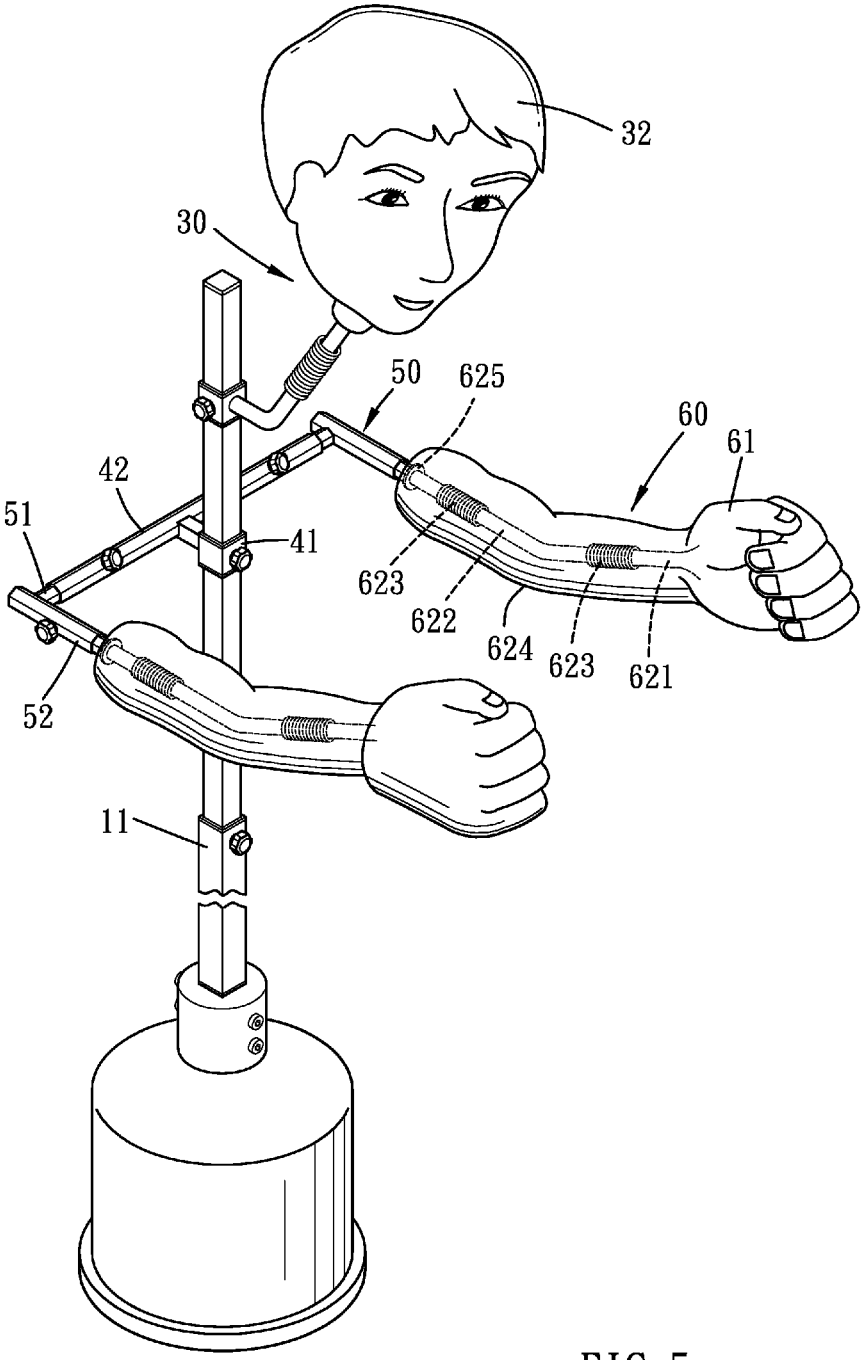
FIG. 5 is a combination drawing showing a kung fu training device in accordance with a second preferred embodiment of the present invention.
Figure 6:
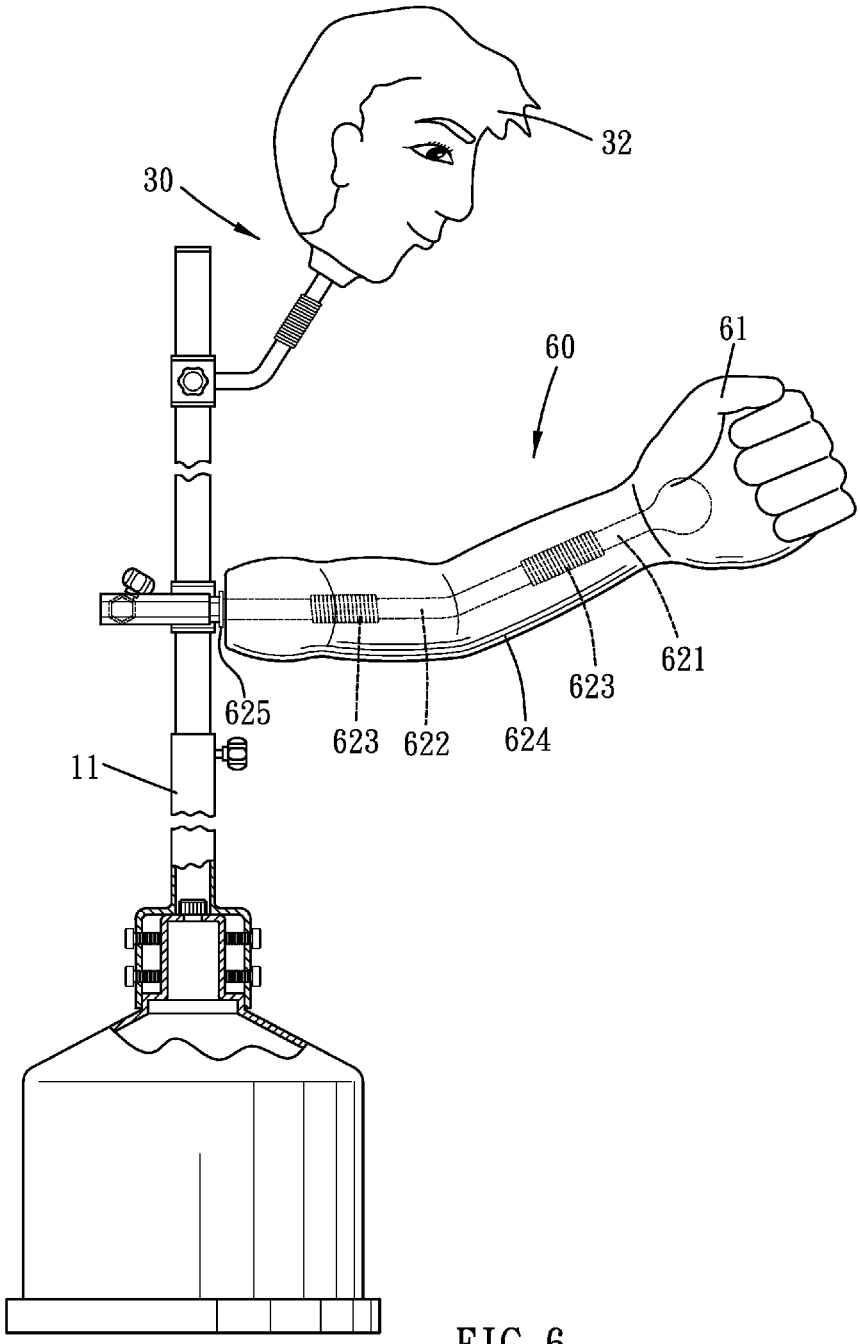
FIG. 6 is a partial side perspective drawing showing a kung fu training device in accordance with a second preferred embodiment of the present invention.

Refer to FIG. 5 and FIG. 6 for the second embodiment of the present invention. Both the forearm 621 and the upperarm 622 have an arm coil spring 623 and two sub-sections respectively. Therefore, the arm connector 62 may slightly deform as the fist pad 61 being punched. For training safety and aesthetic purpose, two foam sleeves 624 are used to enclose the arm connectors 62 respectively. Furthermore, each arm connector 62 has a flange 625 disposed close to its corresponding polygonal hole, and the foam sleeve 624 is disposed between the flange 625 and the fist pad 61 so that it is free from being inadvertently stocked in the polygonal hole. The fist pad 61, just like the head pad 32, may be an air bag, a foaming object or the same to provide suitable feedback.

Figure 7:
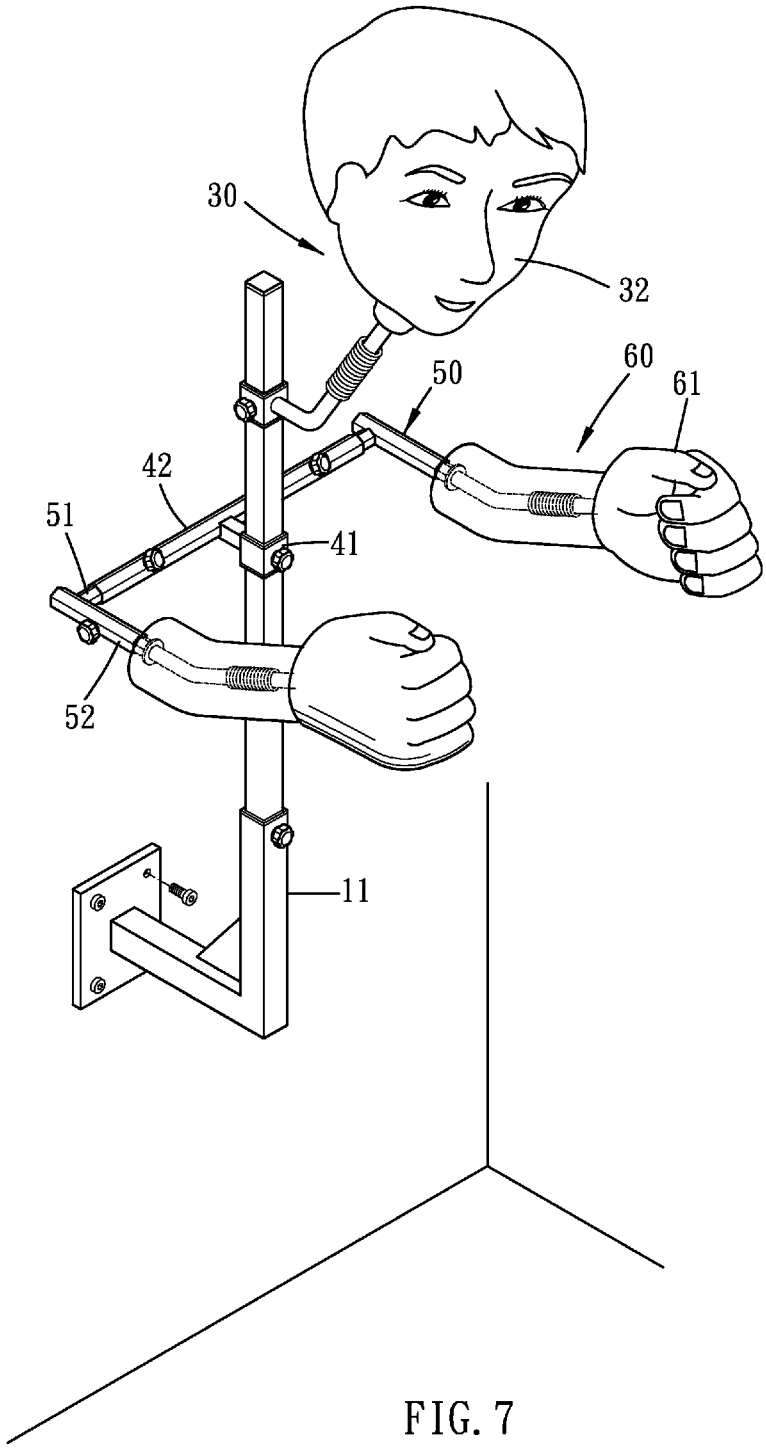
FIG. 7 is a combination drawing showing a kung fu training device in accordance with a third preferred embodiment of the present invention.

As shown in FIG. 7, the positioning portion 10 may be bent to have an angle of 90 degrees, and its distal end is therefore suitable to fix on a wall.

Figure 8:
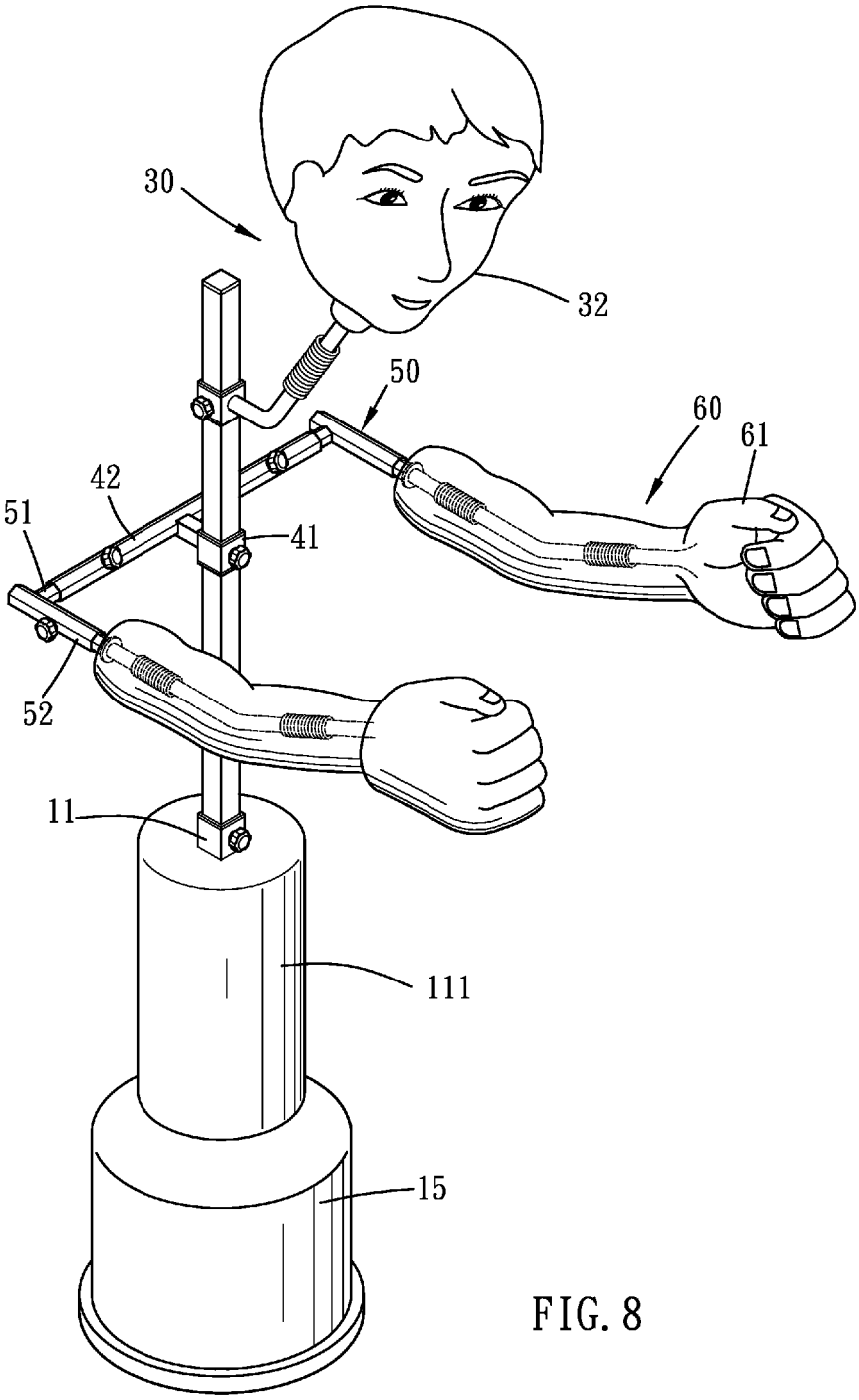
FIG. 8 is a combination drawing showing a kung fu training device in accordance with a fourth preferred embodiment of the present invention.

As shown in FIG. 8, a cushion pad 111 may be provided to surround the socket 11 for trainees to practice striking legs of a simulating enemy. In addition, the cushion pad 111 may further surround a part of the body pole 20 and the sleeve 12.

Figure 9:
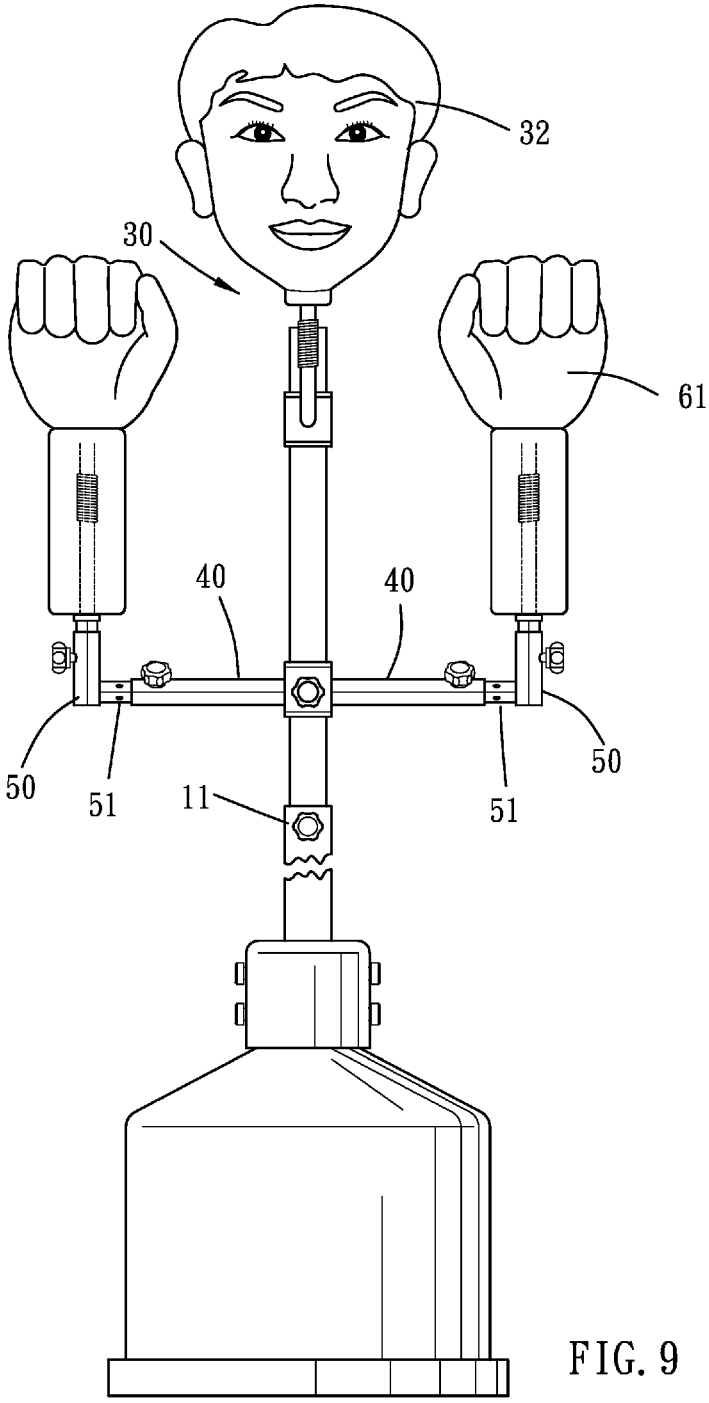
FIG. 9 is a front view showing a usage state of a kung fu training device in accordance with a first preferred embodiment of the present invention.
Figure 10:
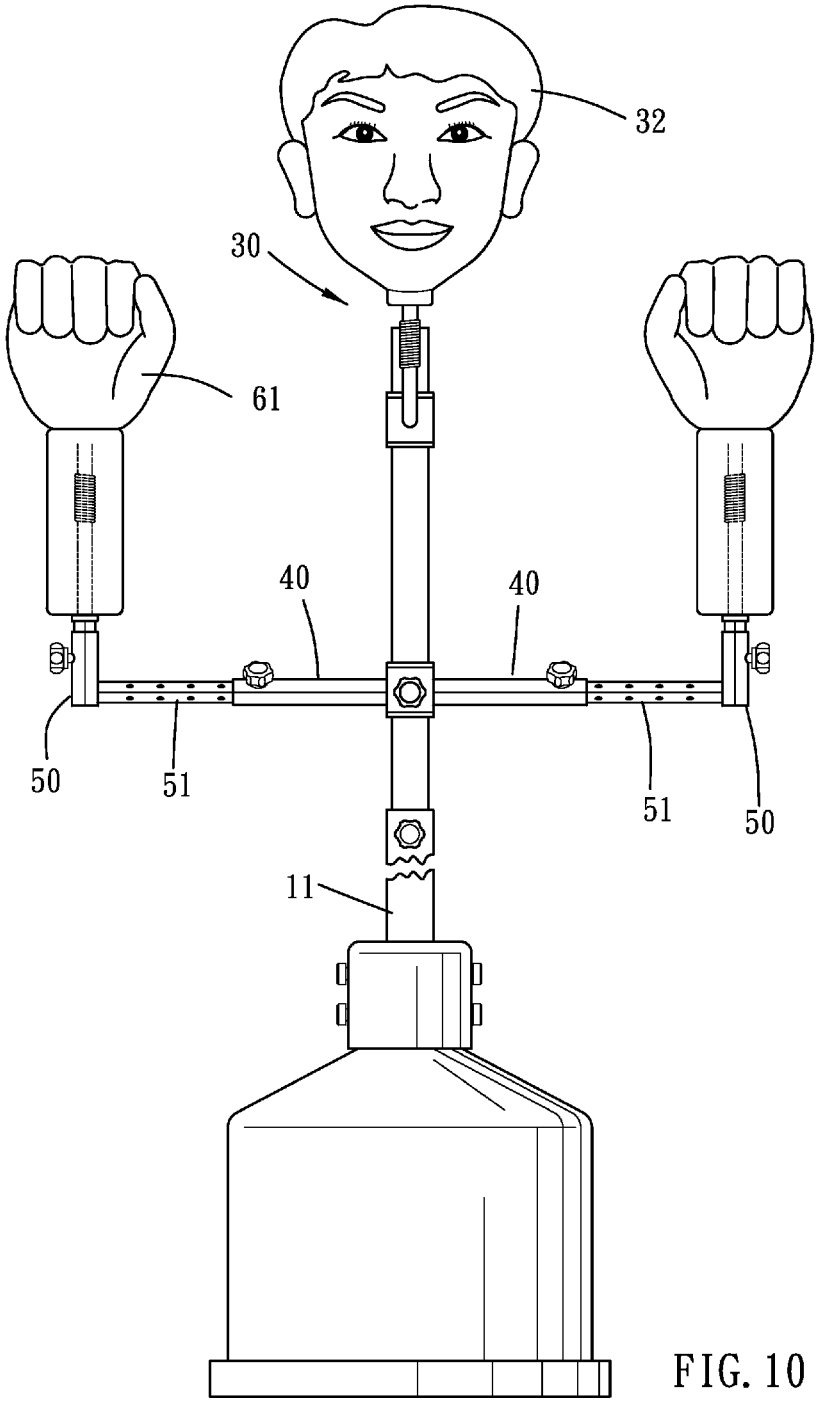
FIG. 10 is a front view showing another usage state of a kung fu training device in accordance with a first preferred embodiment of the present invention.

In summary, the head portion, the body pole, the shoulder portion, the joint portion and the arm portion define a solid space, i.e. they are not co-planar. Also, the heights of the head pad and the fist pads are adjustable, and distances between the head pad and the fist pads are adjustable as well. The joint portions are axially rotatable about the shoulder portion, and the depth of their insertion into the pivoting ends is adjustable. Likewise, the arm portions are axially rotatable about the joint portions, and the depth of their insertion into the second joint is adjustable as well. Therefore, when a trainee has a smaller body size or he/she wants to practice fighting with a simulating enemy with a smaller body size, the position of the head portion and the shoulder portion can be lowered, the joint portions can be deeply inserted into the pivoting ends, and the arm connectors can also be inserted into the second joints deeply, shortening the distance between the head pad and the two fist pads, as shown in FIG. 9. On the other hand, when a trainee has a taller body size or he/she wants to practice fighting with a bigger simulating enemy, the position of the head portion and the shoulder portion can be elevated, the joint portions can be shallowly inserted into the pivoting ends, and the arm connectors can also be shallowly inserted into the second joints, so as to increase the distance between the head pad and the fist pads, as shown in FIG. 10. In addition, because the joint portion is axially rotatable about the shoulder portion, the arm portions can, therefore, be lifted at different height. Due to the arm portion being rotatable about the joint portion, and further due to the arm connector being 15-degree-bent, the position of the fist pad can vary between six corners of a hexagon (owing to the polygonal hole/pole being hexagonal). As such, the trainee can practice fighting with a simulating enemy with different postures or so called attack/defense tricks.

The present invention utilizes the combination of polygonal holes and polygonal poles to make the arm portion rotatable. Due to the polygonal poles has larger contact area with the polygonal holes, the arm portions of the present invention can load more punching strength from a trainee. Any undesired rotation of the arm portion is therefore prohibited. Further owing to the gasket, the polygonal holes and polygonal poles will wear for a much longer time. Therefore, the kung fu training device of the present invention is more durable than the prior art.

What is claimed is:

1. A kung fu training device, comprising:

a positioning portion, having a socket with an opening facing upward;

a body pole, a bottom end thereof being inserted into the socket;

a head portion, having a head tube, a head pad and a head connector connecting the head tube with the head pad, the head tube releasably surrounding a part of the body pole;

a shoulder portion, having a shoulder tube and a lateral rod, the shoulder tube being connected to the lateral rod, the lateral rod having two pivoting ends on two opposite ends thereof, the shoulder tube releasably surrounding a part of the body pole;

two joint portions, each of which has a first joint and a second joint connecting to the first joint, an included angle being defined between the first joint and the second joint;

two arm portions, each of which has a fist pad and an arm connector, the arm connector being disposed between the fist pad and the second joint; wherein one of each pivoting end and its corresponding first joint has a right polygonal hole, the other of each pivoting end and its corresponding first joint has a right polygonal pole; wherein one of each second joint and its corresponding arm connector has a right polygonal hole, the other of each second joint and its corresponding arm connector has a right polygonal pole; wherein each right polygonal hole is defined by several side walls, at least one of the side walls has at least one bore penetrating such side wall, the at least one bore is disposed along a longitudinal direction of the side wall, each right polygonal pole has several pole surfaces, at least one of the pole surfaces has at least one fixation hole disposed along a longitudinal direction of such pole surface; wherein among each polygonal pole and its corresponding polygonal hole, at least one of an amount of the side wall(s) having the at least one bore and an amount of the pole surface(s) having the at least one fixation hole is a complex number, among each side wall and its corresponding pole surface, at least one of an amount of the bore(s) disposed on the side wall and an amount of the fixation hole(s) disposed on the pole surface is a complex number;

several pins, inserting in the bores and their corresponding fixation holes respectively; and an adjusting means to adjust relative positions between the socket, the head tube, the shoulder tube and the body pole;

whereby, the head portion, the body pole, the shoulder portion, the joint portion and the arm portion define a solid space, heights of the head pad and the fist pads are adjustable, and distances between the head pad and the fist pads are also adjustable.

2. The kung fu training device of claim 1, wherein the head connector comprises a first section, a second section and a head coil spring, one end of the first section connects to the head tube, one end of the second section connects to the head pad, distal ends of the first section and the second section are formed with threads that mate with two ends of the head coil spring respectively.

3. The kung fu training device of claim 2, wherein the first section being bent upward.

4. The kung fu training device of claim 1, wherein the arm connector being bent into a forearm and an upperarm, an included angle of 15 degrees is defined between the forearm and the upperarm.

5. The kung fu training device of claim 4, wherein at least one of the forearm and the upperarm has an arm coil spring and two sub-sections, the arm coil spring is disposed between the sub-sections, two ends of the arm coil spring mate with the sub-sections respectively.

6. The kung fu training device of claim 1, wherein between each right polygonal hole and its corresponding right polygonal pole is disposed a gasket.

7. The kung fu training device of claim 1, wherein two foam sleeves enclose the arm connectors respectively.

8. The kung fu training device of claim 7, wherein each arm connector has a flange disposed close to its corresponding polygonal hole, the foam sleeve is disposed between the flange and its corresponding fist pad.

9. The kung fu training device of claim 1, wherein the adjusting means comprises several holes disposed along a longitudinal direction of the body pole, the adjusting means further comprises a through hole disposed on the head tube, a through hole disposed on the shoulder tube and a through hole disposed on the socket, and several pins insert in the through holes and their corresponding holes respectively for positioning purpose.

10. The kung fu training device of claim 1, wherein a bottom end of the positioning portion has an enlarged sleeve to mate with a protrusion disposed on a base.

11. The kung fu training device of claim 10, wherein the base is stuffed with liquid or solid particles.

12. The kung fu training device of claim 1, wherein the positioning portion is bent to have an angle of 90 degrees, a distal end of the positioning portion is suitable to fix on a wall.

13. The kung fu training device of claim 1, wherein a cushion pad is provided to surround the socket.

* * * * *